US005608928A

United States Patent [19]

Wang

[11] Patent Number: 5,608,928

[45] Date of Patent: Mar. 11, 1997

[54] FAUCET OF A SINK

[76] Inventor: Wen-Mu Wang, No. 32, Lane 266, Fu Te I Rd., Hsi Tze Chen, Taipei Hsien, Taiwan

[21] Appl. No.: 656,765

[22] Filed: Jun. 3, 1996

[51] Int. Cl.[6] ..... E03C 1/042

[52] U.S. Cl. ..... 4/678; 4/676; 4/695; 4/567; 137/801

[58] Field of Search ..... 4/675, 676, 678, 4/695, 567, 570; 137/801, 597

[56] References Cited

U.S. PATENT DOCUMENTS

| | | | |
|---|---|---|---|
| 2,741,258 | 4/1956 | Bletcher et al. | 137/597 |
| 2,992,657 | 7/1961 | Weddendorf, Jr. | 137/597 |
| 3,086,748 | 4/1963 | Reinemann | 4/678 |
| 3,144,878 | 8/1964 | Williams | 137/801 |
| 4,286,623 | 9/1981 | Spanides | 137/597 |
| 4,606,370 | 8/1986 | Geipel et al. | 137/119.05 |
| 4,862,524 | 9/1989 | Kimak | 4/675 |
| 5,185,893 | 2/1993 | Lin | 137/597 |

*Primary Examiner*—Henry J. Recla
*Assistant Examiner*—Charles R. Eloshway
*Attorney, Agent, or Firm*—Varndell Legal Group

[57] ABSTRACT

A faucet which includes a casing having a transverse partition wall and a valve chamber above the partition wall, the partition wall having a through hole for hot water and a through hole for cold water, a water outlet pipe having a spot, a valve mounted in the valve chamber and controlled by a handle to close/open the passage between the valve chamber and the spout, and a shower head adapter and control valve assembly mounted in the water outlet pipe and controlled to close the spout for permitting water to flow from the valve chamber to a shower head, a flexible hot water pipe and a flexible cold water pipe respectively connected to the through hole for hot water and the through hole for cold water by a respective rigid pipe connector, wherein the partition wall of the casing is spaced above the lowest edge of the casing at a distance longer than the length of the rigid pipe connectors of the hot water pipe and cold water pipe; the shower head adapter and control valve assembly has a swivel shower head connector connected to the shower head.

1 Claim, 12 Drawing Sheets

FAUCET OF A SINK

BACKGROUND AND SUMMARY OF THE INVENTION

The present invention relates to faucets, and relates more specifically to such a faucet which can be conveniently installed in any of a variety of sinks and, which has a swivel shower head connector for the connection of a shower head.

FIGS. from 1 to 4 show a faucet for sinks according to the prior art. The faucet has an inside partition wall, which is comprised of a bottom horizontal wall portion, a top horizontal wall portion, and a vertical intermediate wall portion, a through hole for cold water and a through hole for hot water through the inside partition wall. Because the bottom side of the bottom horizontal wall portion is spaced above the lowest edge of the casing at a very short distance, when the flexible cold water pipe and the flexible hot water pipe are respectively connected to the through hole for cold water and the through hole for hot water by respective rigid pipe connectors, the rigid pipe connectors project out of the lowest edge of the casing. This drawback limits the application range of the faucet. For example, the faucet can not be installed in a faucet in which the mounting hole is too small to let the rigid pipe connectors pass. Furthermore, this structure of faucet is complicated to manufacture. When casing the inside partition wall of the faucet, a sand core must be used so that the bottom horizontal wall portion and the top horizontal wall portion can be connected by the intermediate vertical wall portion at different elevations and the through hole for cold water and through hole for hot water can be formed and spaced from each other.

The present invention has been accomplished to provide a faucet which eliminates the aforesaid drawbacks. According to one aspect of the present invention, the faucet comprises a casing having a transverse partition wall and a valve chamber above the partition wall, the partition wall having a through hole for hot water and a through hole for cold water, a water outlet pipe having a spot, a valve mounted in the valve chamber and controlled by handle to close/open the passage between the valve chamber and the spout, a flexible hot water pipe and a flexible cold water pipe respectively connected to the through hole for hot water and the through hole for cold water by a respective rigid pipe connector, wherein the partition wall of the casing is spaced above the lowest edge of the casing at a distance longer than the length of the rigid pipe connectors of the hot water pipe and cold water pipe so that the faucet can be installed in any of a variety of sinks to fit different mounting holes. According to another aspect of the present invention, a shower head adapter and control valve assembly is mounted in the water outlet pipe and controlled to close the spout for permitting water to flow from the valve chamber to a shower head, having a swivel shower head connector for the connection of a shower head.

DETAILED DESCRIPTION OF THE PREFERRED EMBODIMENT

Figure 1:
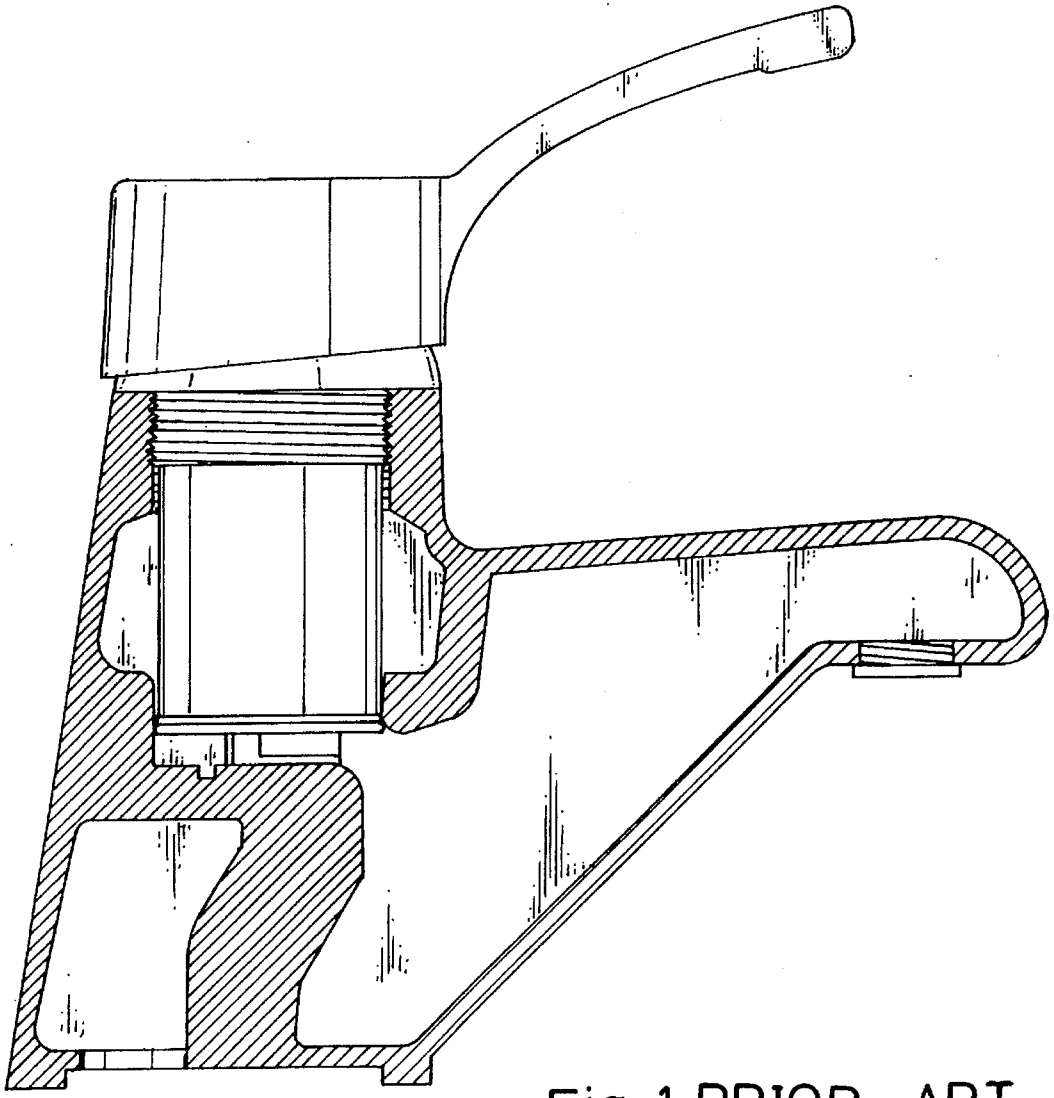
Fig. 1 PRIOR ART
FIG. 1 is a sectional view of a faucet according to the prior art.
Figure 2:
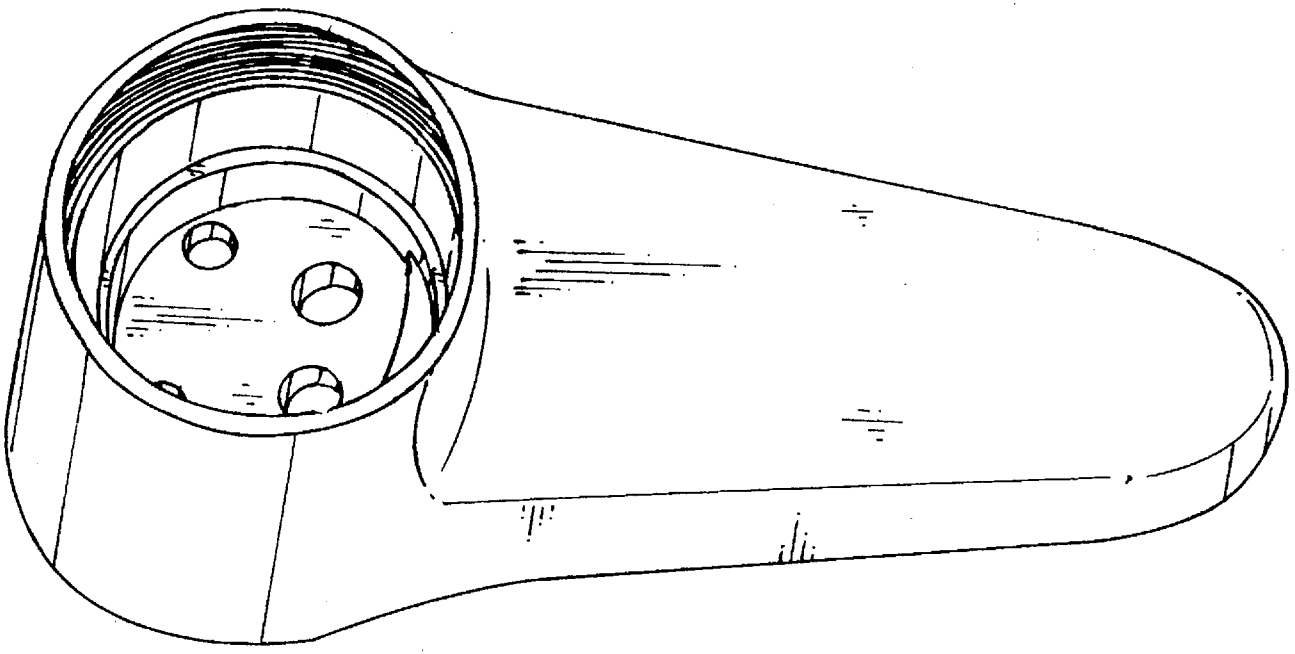
Fig·2 PRIOR ART
FIG. 2 is a top elevational view of the casing of the faucet shown in FIG. 1.
Figure 3:
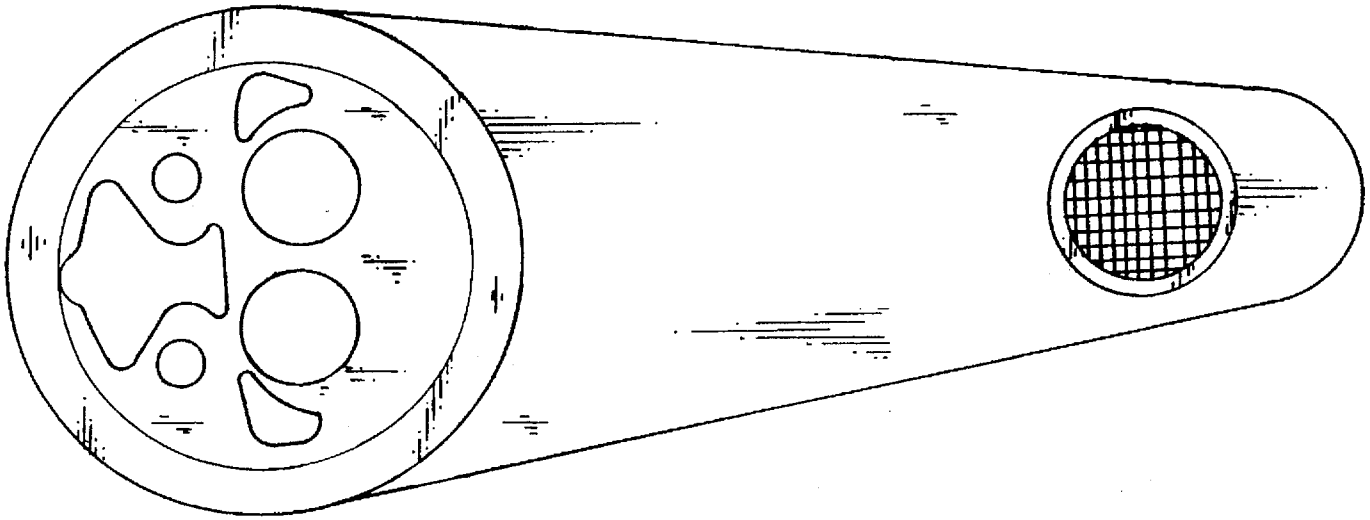
Fig.3 PRIOR ART
FIG. 3 is a bottom view of the casing shown in FIG. 2.
Figure 4:
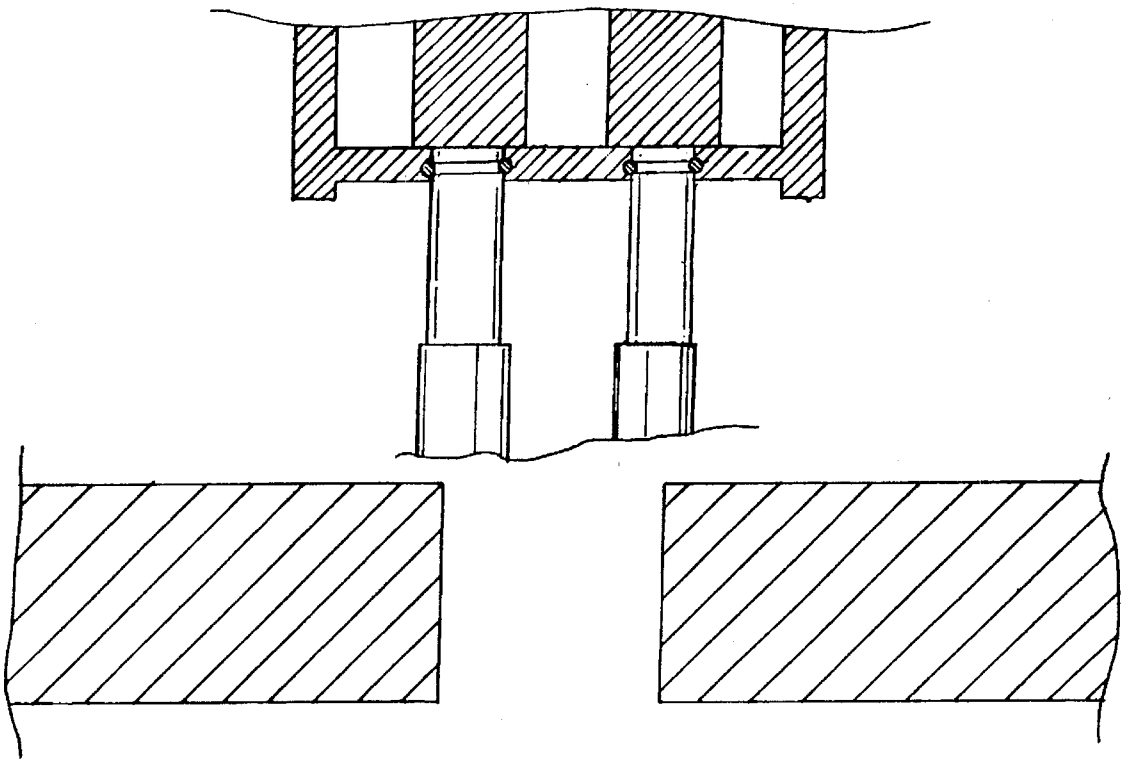
Fig. 4 PRIOR ART
FIG. 4 is a schematic drawing illustrating the installation problem of the prior art faucet in a sink.
Figure 5:
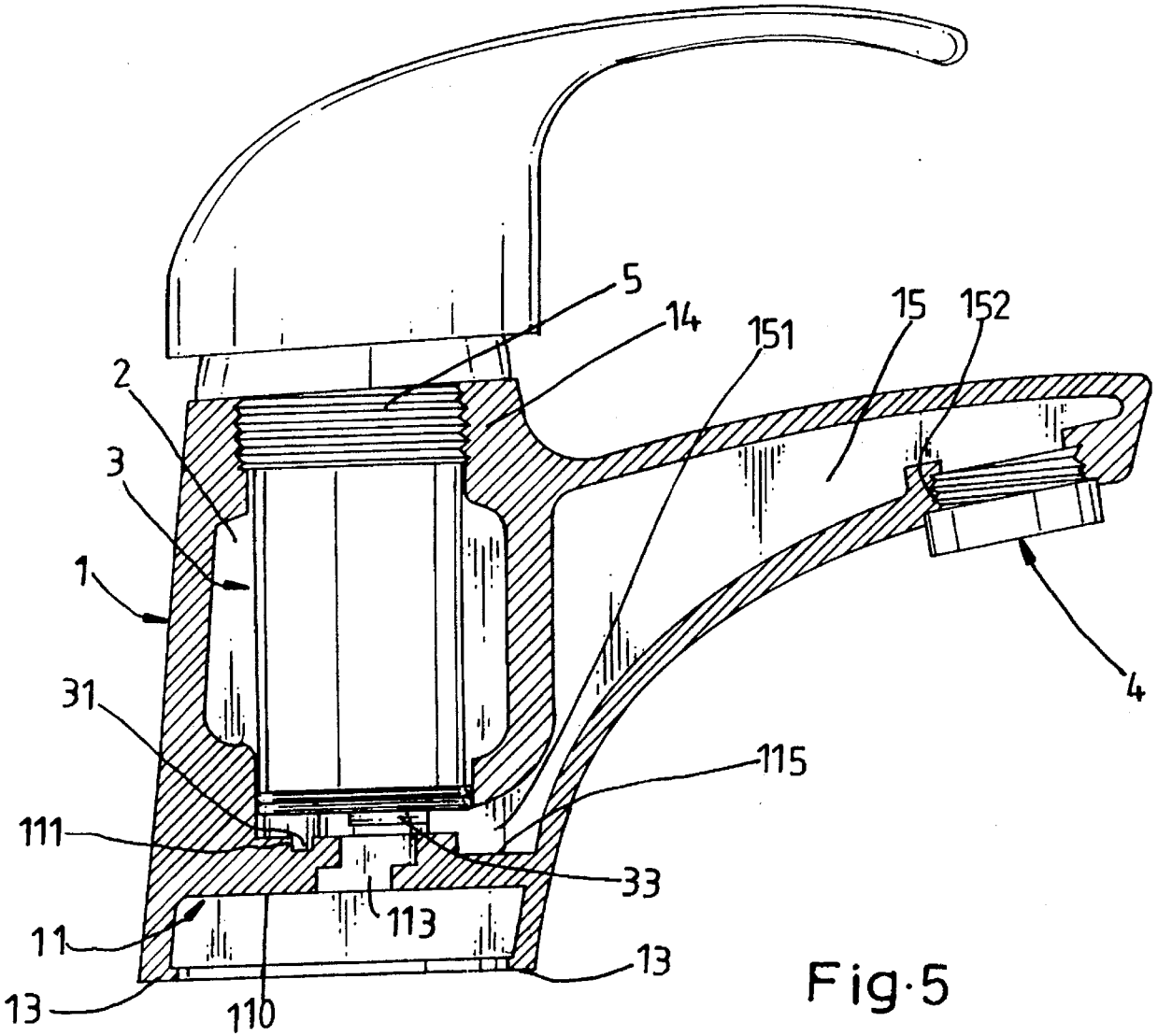
FIG. 5 is a sectional assembly view of a faucet according to a first embodiment of the present invention.
Figure 6:
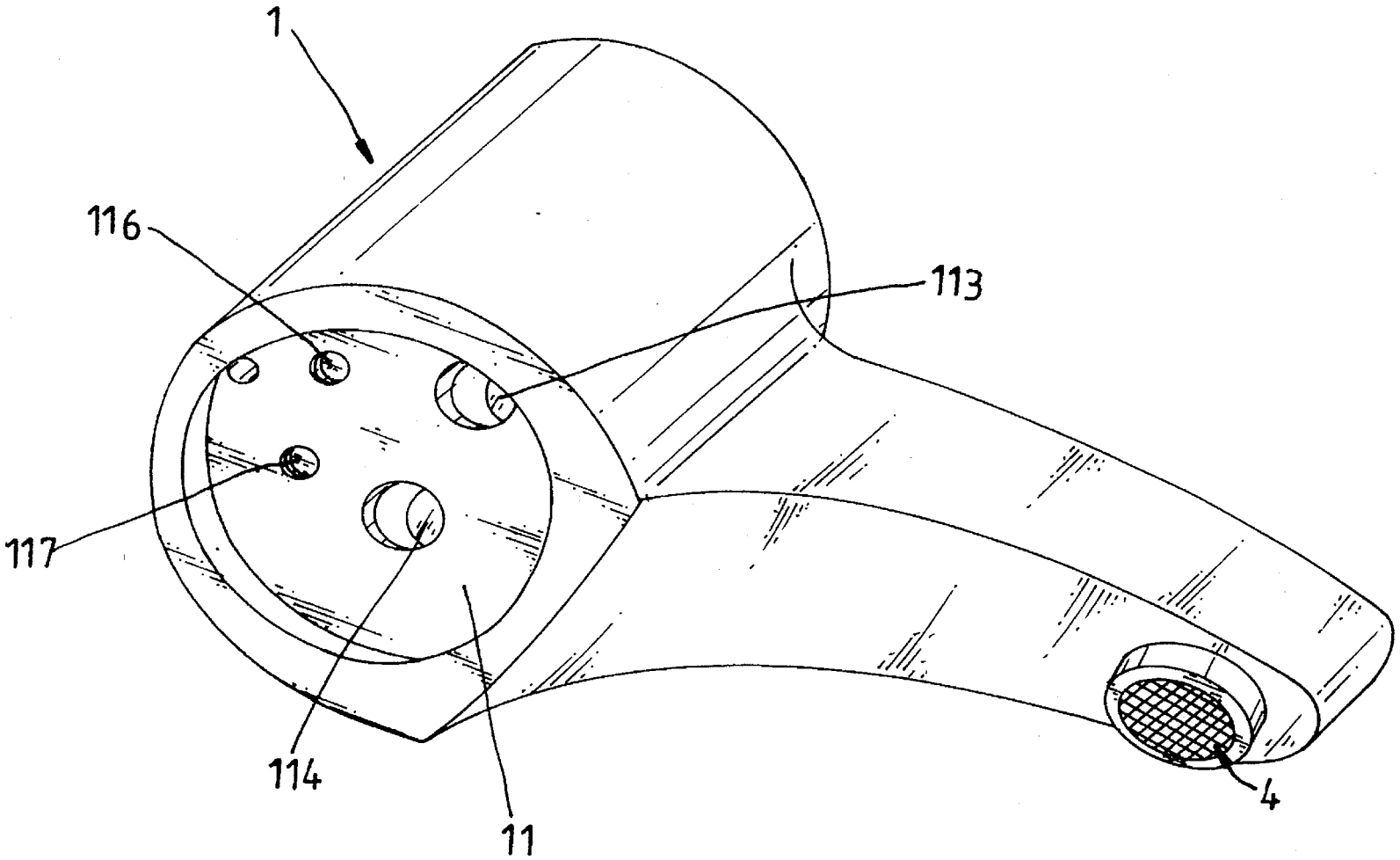
FIG. 6 is an elevational bottom view of the faucet shown in FIG. 5.
Figure 7:
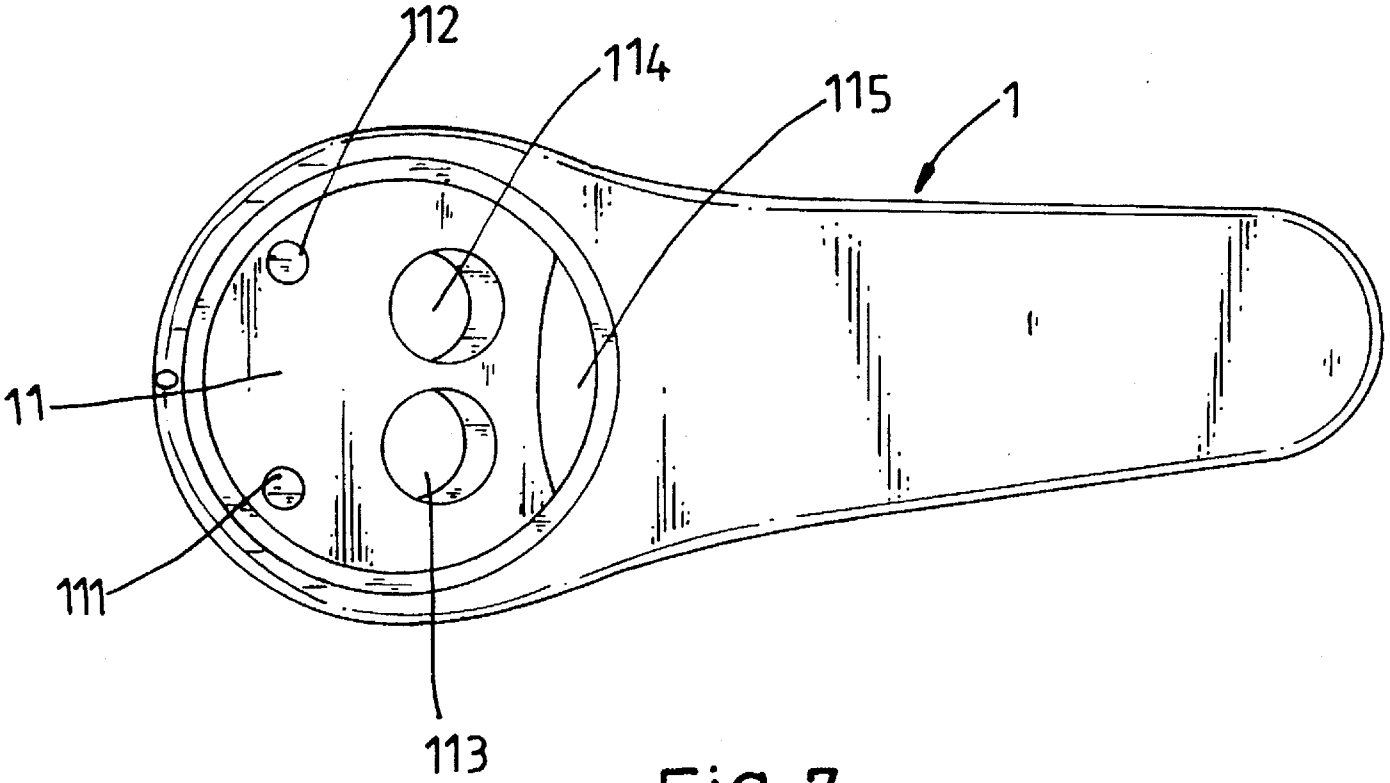
FIG. 7 is a top plain view of the faucet shown in FIG. 5.
Figure 8:
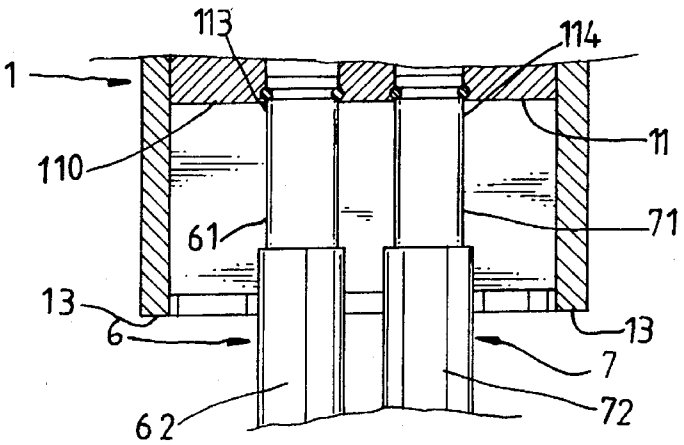
FIG. 8 is a sectional view of the bottom end of the casing of the faucet shown in FIG. 5, showing the cold water pipe and the hot water pipe connected to the respective through holes of the partition wall.
Figure 9:
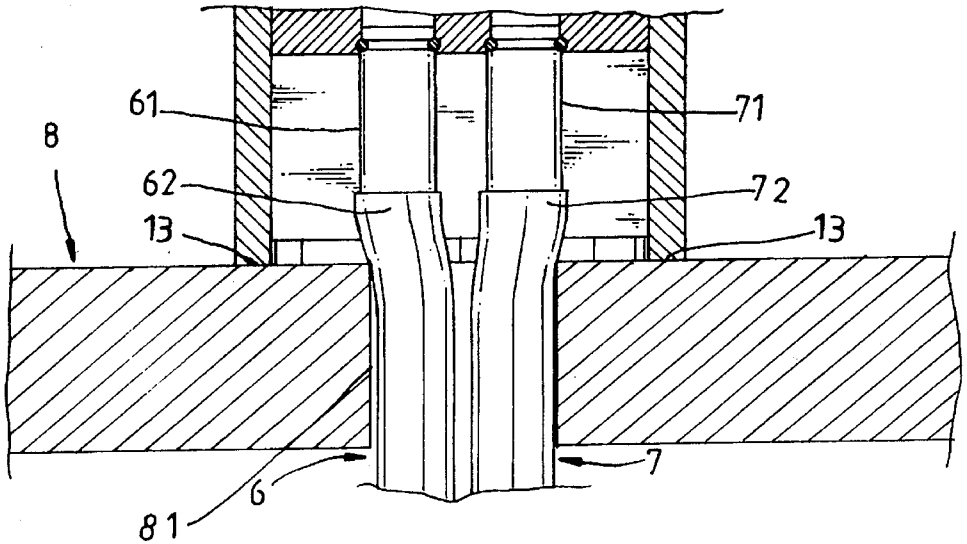
FIG. 9 is another sectional view of the bottom end of the casing of the faucet shown in FIG. 5, showing the casing installed in the sink.
Figure 10:
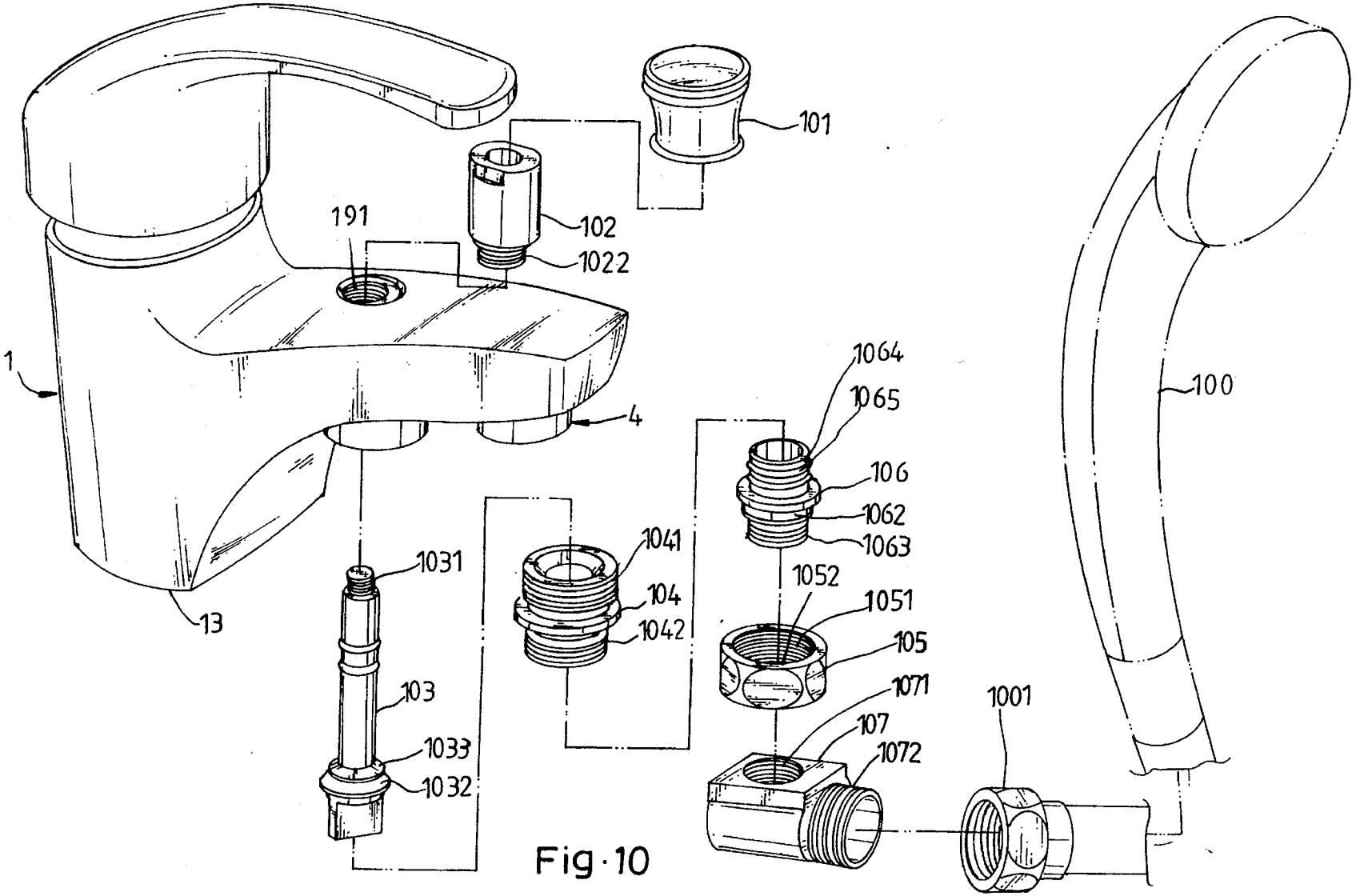
FIG. 10 is an exploded view of a faucet according t,o a second embodiment of the present invention.
Figure 11:
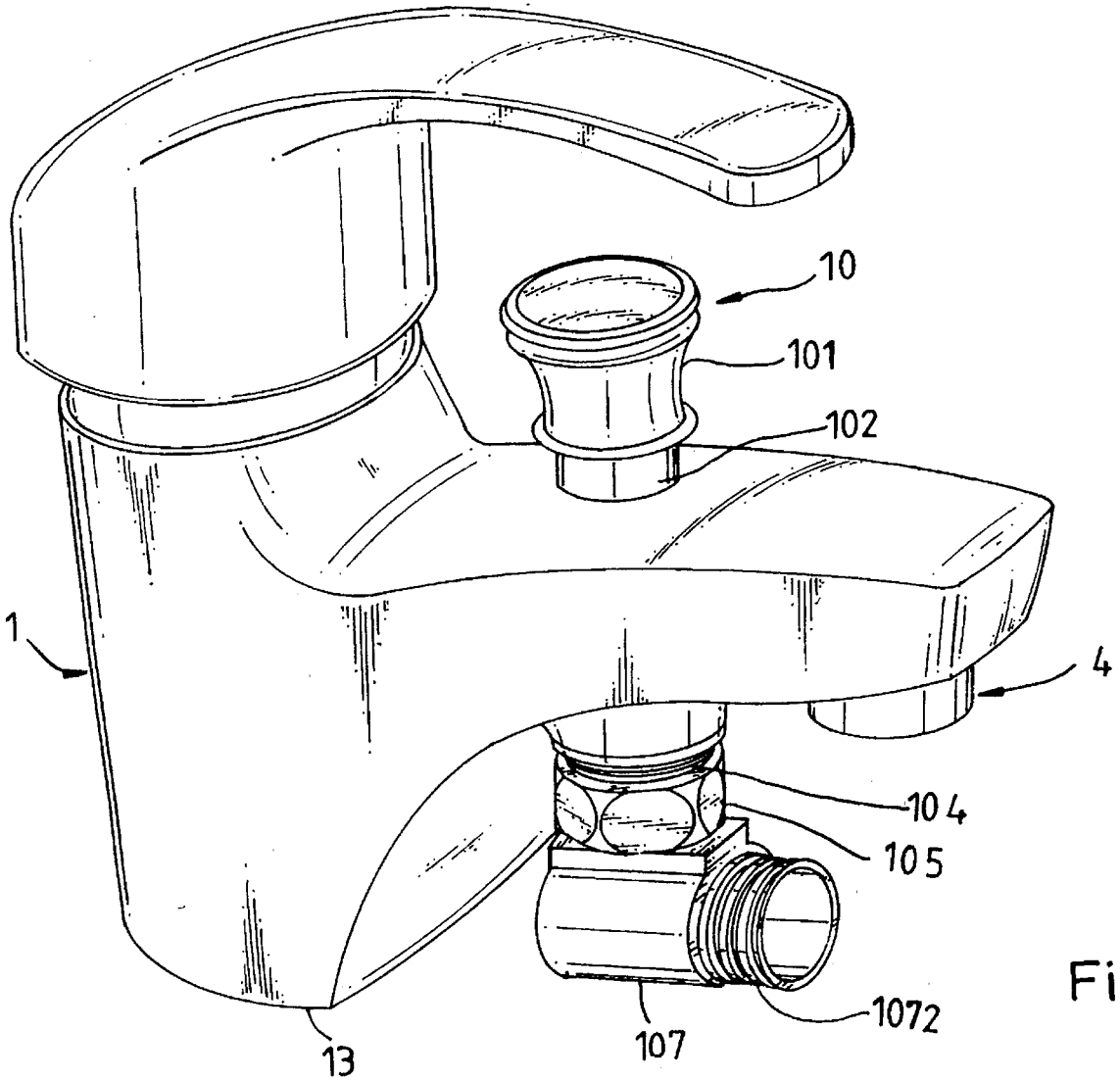
FIG. 11 is an elevational view of the faucet of the second embodiment of the present invention.
Figure 12:
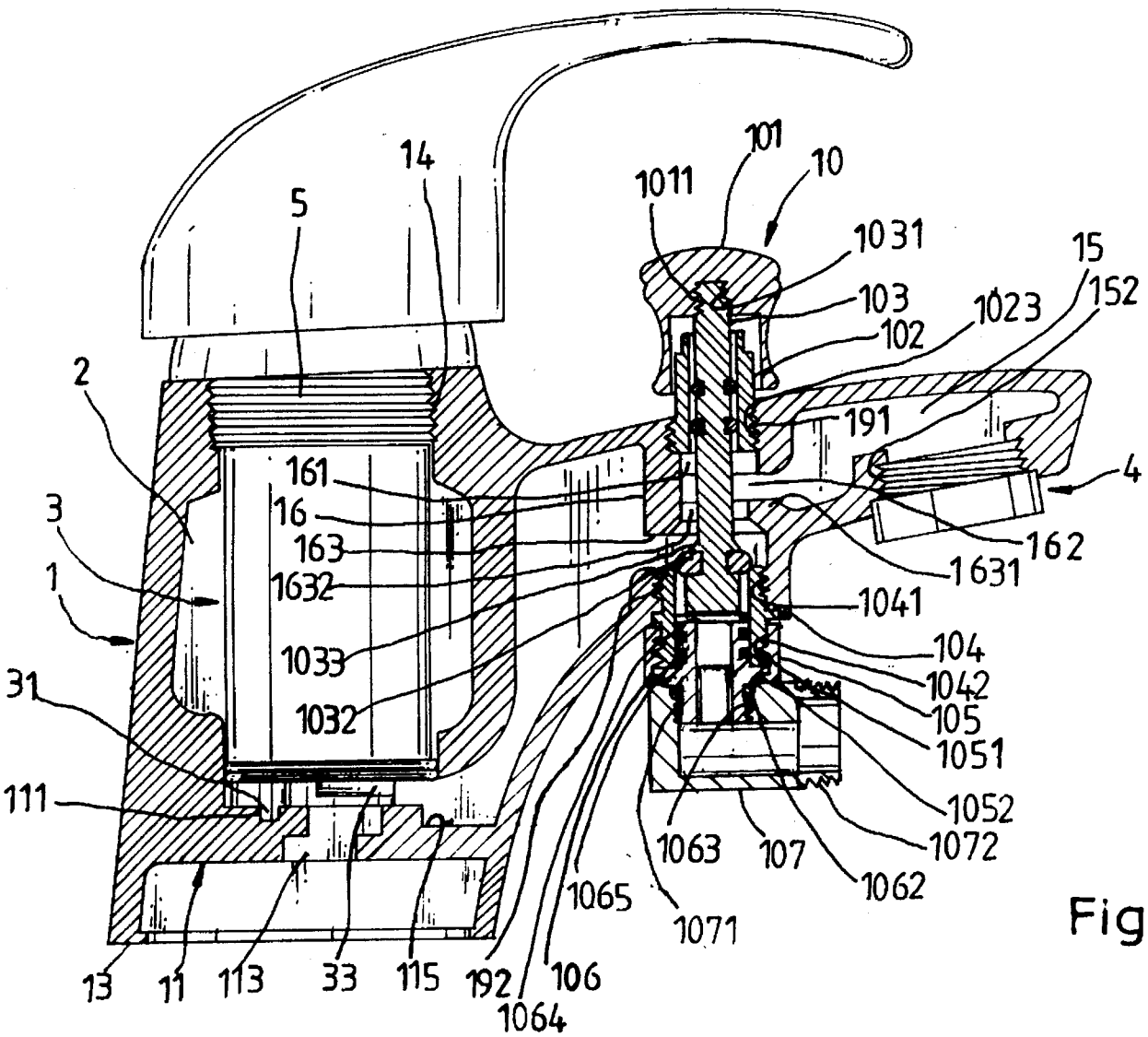
FIG. 12 is a sectional view of the outlet pipe of the faucet of the second embodiment of the present invention, showing the valve stem lowered.
Figure 13:
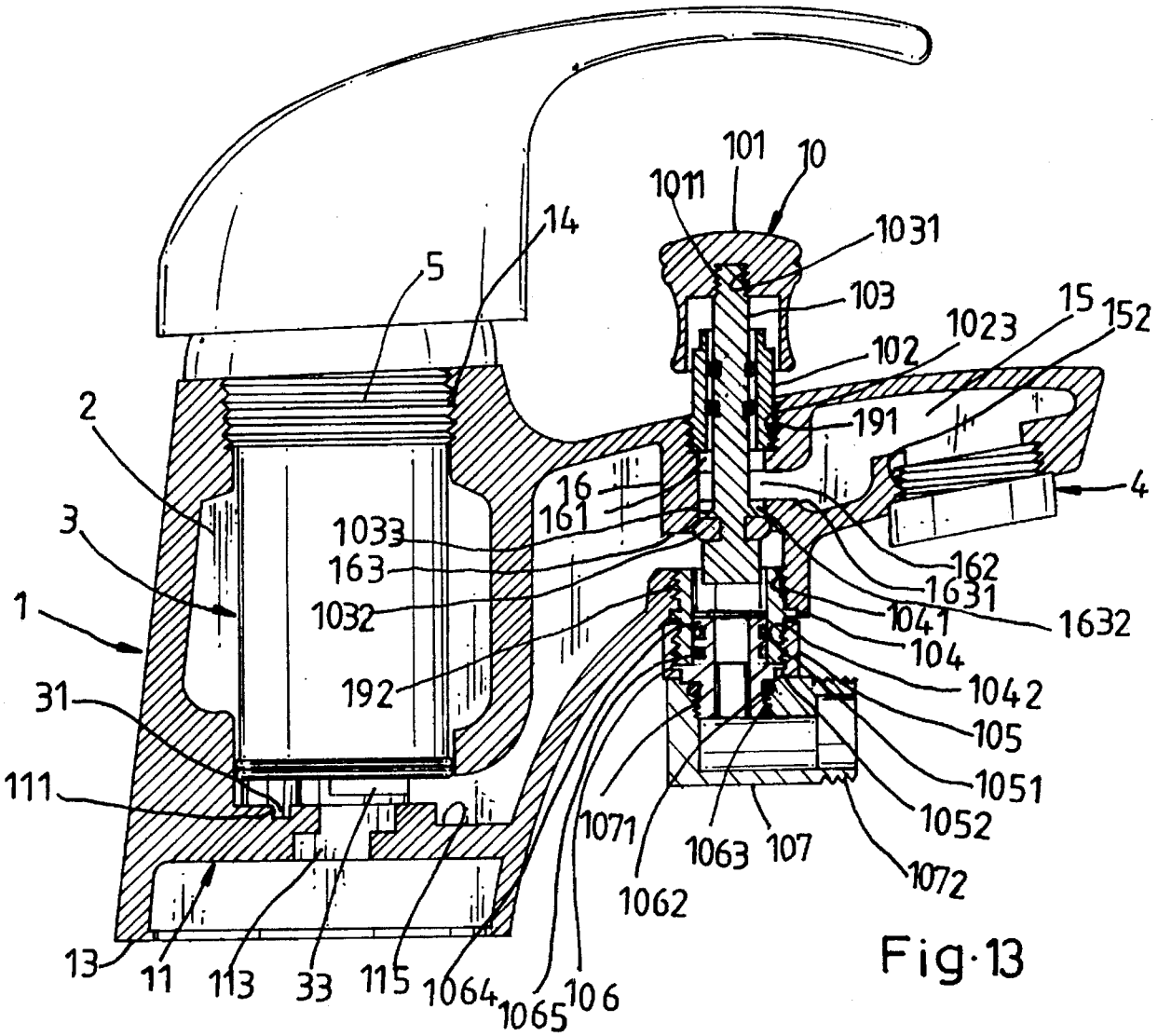
FIG. 13 is a sectional view of the faucet of the second embodiment of the present invention, showing the valve stem lifted.

Referring to FIGS. from 5 to 9, the casing 1 of a faucet according to the first embodiment of the present invention comprises a transverse partition wall 11 near the bottom which has two recessed locating holes 111, 112 at the top (see FIG. 7), a through hole for cold water 113, and a through hole for hot water 114 (see FIG. 8), a valve chamber 2 defined above the partition wall 11, a valve 3 mounted in a valve chamber 2 which has two locating rods 31 respectively fastened to the recessed locating holes 111, 112, a cold water passage 33 and a hot water passage (not shown) disposed in communication with the through hole for cold water 113 and the through hole for hot water 114, a water outlet pipe 15 having a spout 152 for carrying off water, a water chamber 115 disposed in communication with the inner end 151 of the water outlet pipe 15 for guiding water from the valve to the water outlet pipe 15, a meshed cap 4 mounted on the spout 152 of the water outlet pipe 15, an inner thread 14 at the top of the valve chamber 2, a threaded packing member 5 threaded into the inner thread 14 to hold the valve 3 in place, and two screw holes 116, 117 at the bottom of the partition wall 11 (see FIG. 6). Furthermore, a cold water pipe 6 and a hot water pipe 7 are respectively connected to the through hole for cold water 113 and the through hole for hot water 114. When the faucet is installed in a sink 8 as shown in FIGS. 8 and 9, the screw holes 116, 117 are fastened to the sink 8 by respective fastening elements.

Referring to FIGS. 7, 8 and 9 again, the cold water pipe 6 and the hot water pipe 7 have the same structure, each comprised of a flexible pipe body 62 or 72, and a rigid pipe connector 61 or 71 connected between the flexible pipe body 62 or 72 and the through hole 113 or 114. The bottom side 110 of the partition wall 11 is spaced from the bottom edge 13 of the casing 1 at a distance longer than the length of the rigid pipe connectors 61, 71. Because the bottom edge 13 of the casing 1 is disposed at a lower elevation than the rigid pipe connectors 61, 71, the rigid pipe connectors 61, 71 do not touch the sink 8 when the casing 1 is mounted on the sink 8. Therefore, during the installation of the faucet, the flexible pipe bodies 62, 72 of the cold water pipe 6 and hot water pipe 7 can be gathered together and inserted into the through hole 1 of the sink 8 for connection to the hot/cold water supply system. Furthermore, the partition wall 11 and the casing 1 are made in integrity by casing. Therefore, the manufacturing quality of the faucet can be maintained.

FIGS. from 10 to 13 show an alternate form of the faucet of the present invention. According to this alternate form, the casing 1 of the faucet comprises a transverse partition wall 11 near the bottom which has two recessed locating holes 111, 112 at the top, a through hole for cold water 113, and a through hole for hot water 114, a valve chamber 2 defined above the partition wall 11, a valve 3 mounted in a valve chamber 2 which has two locating rods 31 respectively fastened to the recessed locating holes 111, 112, a cold water passage 33 and a hot water passage disposed in communication with the through hole for cold water 113 and the through hole for hot water 114, a water outlet pipe 15 having a spout 152 for carrying off water, a water chamber 115 disposed in communication with the inner end of the water outlet pipe 15 for guiding water from the valve to the water outlet pipe 15, a meshed cap 4 mounted on the spout 152 of the water outlet pipe 15, an inner thread 14 at the top of the valve chamber 2, a threaded packing member 5 threaded into the inner thread 14 to hold the valve 3 in place, two screw holes 116, 117 at the bottom of the partition wall 11 for connection to the sink 8, a cold water pipe 6 and a hot water pipe 7 respectively connected to the through hole for cold water 113 and the through hole for hot water 114, wherein the cold water pipe 6 and the hot water pipe 7 have the same structure, each comprised of a flexible pipe body 62 or 72, and a rigid pipe connector 61 or 71 connected between the flexible pipe body 62 or 72 and the through hole 113 or 114; the bottom side 110 of the partition wall 11 is spaced from the bottom edge 13 of the casing 1 at a distance longer than the length of the rigid pipe connectors 61, 71. The aforesaid structure of the second embodiment of the present invention is similar to that of the first embodiment of the present invention like reference numbers are used for indicating like parts through out the drawings. The only difference between these two embodiments is at the water outlet pipe 15. The second embodiment comprises a shower head adapter and control valve assembly 10 installed in the water outlet pipe 15 of the casing 1 behind the spout 4.

Referring to FIGS. from 10 to 13 again, the water outlet pipe 15 comprises to top screw hole 191, a bottom screw hole 192, and an annular inside wall 16. The annular inside wall 16 defines a top hole 161 disposed in communication with the top screw hole 191 and a front hole 162 connected between the top hole 161 and the spout 152, having a bottom wall 163 connected to the bottom side 1631 of the water outlet pipe 15. The bottom wall 163 has a water hole 1632 aligned between the bottom screw hole 192 and the top hole 161 for guiding water from the valve 3 to the front hole 162 and the spout 152. The shower head adapter and control valve assembly 10 is comprised of a top cap 101, a barrel 102, a valve stem 103, a first connector 104, a lock nut 105, a second connector 106, and a shower head connector 107. The top cap 101 has an inner thread 1011. The barrel 102 has an outer thread 1023 mounted with a water seal ring 1032 and threaded into the top screw hole 191 of the water outlet pipe 15. The valve stem 103 is inserted through the bottom screw hole 192, the water hole 1632, the top hole 161, and the barrel 102, having an outer thread 1031 at the top threaded into the inner thread 1011 of the top cap 101, and a stopper 1033 at the bottom mounted with a water seal ring 1032. The first connector 104 has a first outer thread 1041 at the top threaded into the bottom screw hole 192 of the water outlet pipe 15, and a second outer thread 1042 at the bottom. The lock nut 105 has an inner thread 1051 threaded onto the second outer thread 1042 of the first connector 104, and an inside annular flange 1052 at the bottom. The second connector 106 is mounted in the lock nut 105 and supported on the inside annular flange 1052, having an externally threaded bottom end 1063 mounted with a water seal ring 1062 and projecting out of the bottom side of lock nut 105, and a top end 1064 mounted with a water seal ring 1065 and inserted into the first connector 104. The shower head connector 107 has a top screw hole 1071 threaded onto the externally threaded bottom end 1063 of the second connector 106, and an outer thread 1072 at one end adapted for connecting the connector 1001 of a shower head assembly 100. When the shower head adapter and control valve assembly 10 is installed, the second connector 106 can be turned by the shower head connector 107 relative to the first connector 104. Therefore, when the shower head assembly 100 is pulled, the shower head connector 107 is turned to the pulling direction of the shower head assembly 100. When the top cap 101 is pulled up, the valve stem 103 is lifted, causing the stopper 1033 to be moved away from the second connector 106 and forced into engagement with the water hole 1632, and therefore water is allowed to pass from the valve 3 through the second connector 106 to the shower head assembly 100 via the shower head connector 107. When the top cap 101 is pressed down, the valve stem 103 is lowered, causing the stopper 1033 to be moved away from the water hole 1632 and forced into engagement with the second connector 106, and therefore water is allowed to pass from the valve 3 through water hole 1632 to the spout 152 via the front hole 162.

I claim:

1. A faucet comprising:

a casing having an bottom opening and an outlet;

a partition wall positioned transversely of said bottom opening and spaced a distance therefrom inside of said casing, said partition wall including hot and cold water through-holes and recessed locating holes;

rigid pipe connectors, each respectively connected to one of said hot and cold water through-holes, said rigid pipes adapted for connection to flexible hot and cold water supply pipes for supplying hot and cold water to said faucet, said partition wall being spaced from said bottom opening of said casing such that, when said casing is mounted upon a support surface, said rigid pipe connectors do not contact said support surface and said flexible supply pipes can be gathered together upon said rigid pipe connectors;

a water outlet pipe extending from said outlet of said casing, said water outlet pipe comprising a spout at an end thereof covered with a mesh cap and having a bore extending transversely therethrough, said bore further having interior connecting threads at opposite top and bottom ends thereof, said water outlet pipe further having a first water conduit communicating said spout with said outlet of said casing and a second water conduit communicating said outlet of said casing with said bottom end of said bore;

a valve mounted in said casing between said bottom opening and said outlet and connected to said rigid pipe connectors, said valve being operable by a handle to selectively mix and admit water from said hot and cold water supply pipes, through said rigid pipe connectors and said outlet, to said water outlet pipe, said valve having two locating rods extending therefrom which are received in said recessed locating holes in said partition wall;

a hollow connector having exterior threads for connection to said interior threads at said top end of said bore;

a first connector having exterior threads for connection to said interior threads at said bottom end of said bore;

a second connector sealingly mounted in said first connector;

a nut fixedly mounted around said first connector to sealingly hold said second connector to said first connector;

a shower head connector having one end sealingly connected to said second connector and an opposite end adapted for connection to a shower head;

a valve stem inserted in said bore with a top end thereof having threads and extending through said hollow connector and a bottom end thereof located proximate said second connector;

a cap having interior threads connected to said threaded top end of said valve stem exteriorly of said hollow connector;

a water stopper and a water seal ring mounted to said bottom end of said valve stem;

whereby, when said valve stem is pulled upwardly from a first position via said cap to a second position, said water sealing ring and said stopper close said first water conduit so that water flows from said valve, through said outlet in said casing, into said second water conduit, and through said shower head connector to supply water to said shower head, and when said cap is in said first position, said water sealing ring and said stopper close said second water conduit so that water flows from said valve, through said outlet in said casing, into said first water conduit, and through said spout.

* * * * *